US006234871B1

(12) United States Patent
Chaloupek et al.

(10) Patent No.: US 6,234,871 B1
(45) Date of Patent: May 22, 2001

(54) METHOD AND APPARATUS FOR REMOVING A THIN COATING FROM A FABRIC

(75) Inventors: Kenneth W. Chaloupek, Medina; Allen F. Simon, Sylvania; Harold P. Sponseller, Maumee, all of OH (US)

(73) Assignee: Seaman Corporation, Wooster, OH (US)

( * ) Notice: Subject to any disclaimer, the term of this patent is extended or adjusted under 35 U.S.C. 154(b) by 0 days.

(21) Appl. No.: 09/426,953

(22) Filed: Oct. 26, 1999

(51) Int. Cl.[7] ..... B24B 49/00

(52) U.S. Cl. ..... 451/11; 451/59; 451/12; 451/14

(58) Field of Search ..... 451/8, 11, 12, 451/14, 15, 59, 301, 303

(56) References Cited

U.S. PATENT DOCUMENTS 4,601,134 * 7/1986 Hessemann ..... 451/8
4,839,994 * 6/1989 Heesemann ..... 451/8
5,386,665 * 2/1995 Heim ..... 451/8
5,613,901 * 3/1997 Weber et al. ..... 451/303

* cited by examiner

*Primary Examiner*—M. Rachuba
(74) *Attorney, Agent, or Firm*—Renner, Kenner, Greive, Bobak, Taylor & Weber

(57) ABSTRACT

An apparatus for removing a thin film of material from a portion (23) of a sheet of fabric (22) and its method of operation, includes a grinder wheel (19) spaced from a nip roller (29) which is carried by an arm (32). The initial spacing between the grinder wheel (19) and the nip roller (29) is established by an adjusting mechanism (37) which pivots the arm (32), that spacing being determined by the expected thickness of the fabric (22). Pinch rollers (27) move the fabric (22) through the space, and a thickness-sensing wheel (44) rides on the fabric (22) upstream of the nip roller (29). Upon a change in the thickness of the fabric (22), a sensing arm (45) which carries the sensing wheel (44) pivots which, through a link arm (54), pivots a regulator arm (61) which carries a follower roller (70) that rides on the arm (32). Such allows the nip roller (29) to move toward or away from the grinder wheel (19) dependent on the thickness of the fabric (22) sensed by the movement of the sensing wheel (44).

20 Claims, 9 Drawing Sheets

METHOD AND APPARATUS FOR REMOVING A THIN COATING FROM A FABRIC

TECHNICAL FIELD

This invention relates to a device which precisely removes a thin film or coating from a fabric. More specifically, this invention relates to such a device, and its method of operation, which will remove this thin coating without damage to the fabric irrespective of varying thicknesses of the fabric.

BACKGROUND ART

Coated fabrics are well known in the art. Typically, such fabrics include a woven base cloth formed of a polyester or nylon material which is then coated on both sides by a weather-resistant material such as polyvinylchloride. Panels of such a fabric are then attached to form the finished product which could be something as simple as a tarpaulin for an athletic field or, more frequently, an outdoor building structure such as a tension structure or air-supported structure such as is used to house tennis courts or the like. The panels are most often attached to form such final products by overlapping the edges of two panels and thermal or radio-frequency welding the overlapped edges together to form a seam.

Oftentimes these fabrics are also further coated, at least on one side, with other materials such as a film sold under the trademark TEDLAR® by DuPont. Such materials are advantageous for the coated fabric in that they provide enhanced weather resistance, in that they are more readily cleaned, and in that they present a more aesthetically pleasing appearance. Despite the advantages of the TEDLAR®-coated fabric, its use is limited or problematic in that TEDLAR® material is not susceptible to thermal or radio-frequency welding to form the finished product.

The only manner in which to accomplish such welding of a fabric coated with the TEDLAR® or similar materials would be to remove that material near the edges of a panel so that the polyvinylchloride therebelow could be welded to another similarly formed panel. However, because the thickness of these films is typically about 0.001 inch, with the total thickness of the coated fabric being approximately 0.035 inch, the removal of the film is quite difficult. Such is particularly the case when the overall thickness of the fabric varies, as is often the case. To date, there is no known device which can accurately remove this thin film of material without damage to the base fabric irrespective of any variances in overall thickness of the fabric.

DISCLOSURE OF THE INVENTION

It is thus an object of the present invention to provide a device for removing a thin film of material from an edge of a sheet of fabric so that two sheets may be attached at their overlapping edges where the film has been removed.

It is another object of the present invention to provide a device, as above, which can operate to accurately remove the thin film without damage to the fabric.

It is a further object of the present invention to provide a device, as above, which is automatically adjustable to account for thickness variations in the fabric.

These and other objects of the present invention, as well as the advantages thereof over existing prior art forms, which will become apparent from the description to follow, are accomplished by the improvements hereinafter described and claimed.

In general, an apparatus for removing a thin film of material from a portion of a sheet of fabric, in accordance with the present invention, includes a grinding mechanism which is opposed to and spaced from a nip member, the fabric being positionable in that space. A fabric thickness-sensing system is operatively connected to the nip member to adjust the size of the space between the nip member and the grinding mechanism dependent on the thickness of the fabric so that the thin film is removed from the fabric irrespective of variances in the thickness of the fabric.

In accordance with another aspect of the present invention, the above apparatus is provided with a mechanism operatively connected to the nip member to establish the size of the space between the nip member and the grinding mechanism dependent on the anticipated thickness of the fabric and the film to be removed therefrom.

The method of the present invention incorporates the steps of positioning a nip member adjacent to and spaced from a grinding mechanism, passing a portion of a sheet of fabric between the nip member and grinding mechanism so that the grinding mechanism removes a thin film from a portion of the fabric, continually sensing the thickness of the fabric before the fabric passes between the nip member and the grinding mechanism, and adjusting the space between the nip member and the grinding mechanism dependent on the sensed thickness.

A preferred exemplary device for removing a thin film of material from an edge of a sheet of fabric, which incorporates the concepts of the present invention, is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
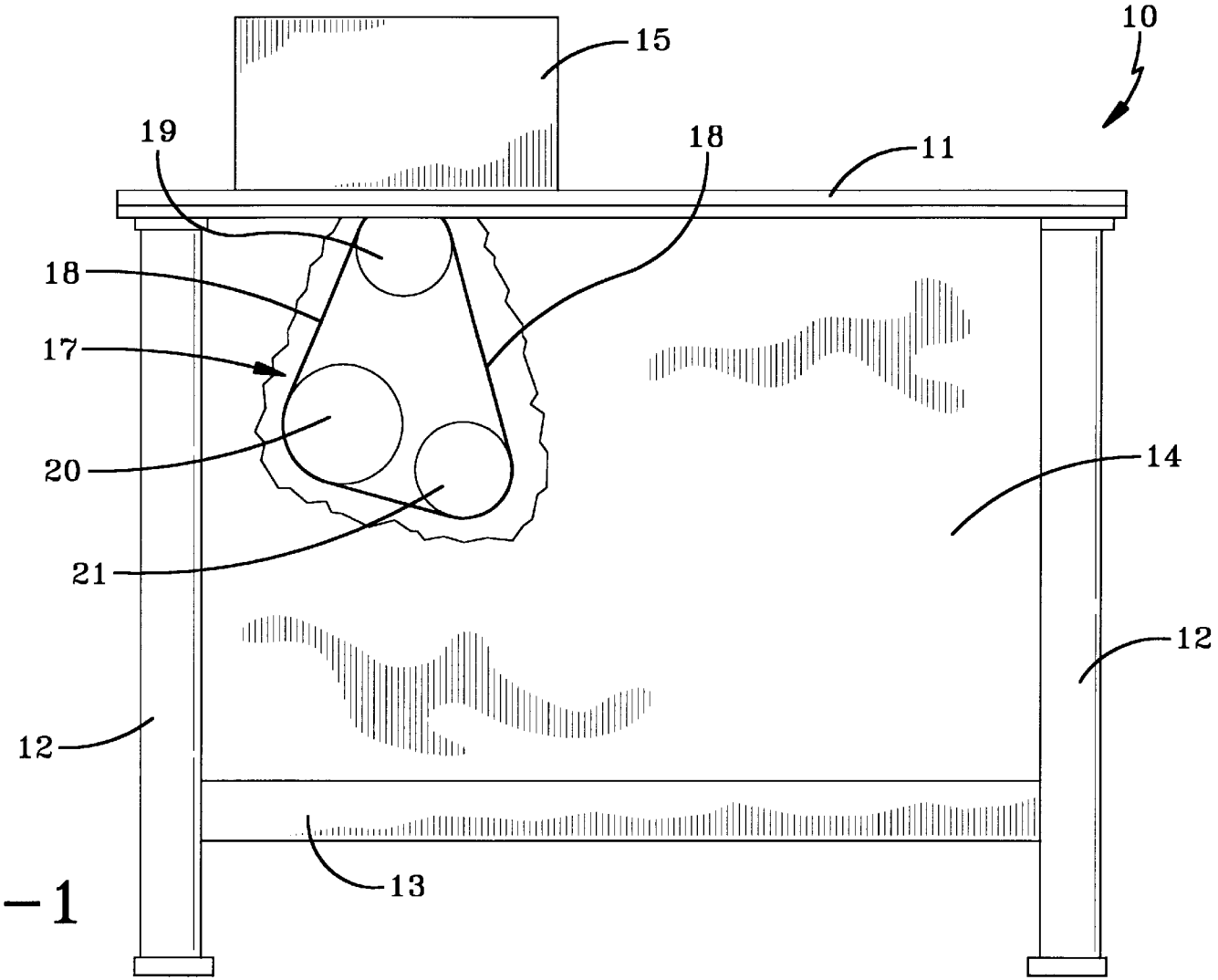
FIG. 1 is a partially broken away, somewhat schematic side elevational view of a device made in accordance with the present invention.

A device for removing a thin film of material from a fabric is indicated generally by the numeral 10 and includes a longitudinally extending upper, horizontal table 11 supported by four legs 12 (two shown in FIG. 1). Crossbeams 13 may be provided between each adjacent leg 12, and side or end walls 14 are provided above crossbeams 13 and between adjacent legs 12 to enclose the components of film-removing device 10, such as the electrical controls and the like (not shown). If desired to render device 10 mobile, the bottoms of legs 12 could readily be provided with wheels. Table 11 supports an enclosure framework 15 which houses the components of a control mechanism shown in FIG. 3 and generally indicated by the numeral 16.

A grinding assembly is schematically shown in FIG. 1 and indicated generally by the numeral 17. Assembly 17 includes a grinder belt 18, which can be formed of any suitable abrasive material and which extends around a grinder wheel 19, a driven roller 20, and an idler roller 21. Roller 20 thus moves belt 18, for example, in a counter-clockwise direction around the periphery of idler roller 21 and grinder wheel 19. It has been found that a speed of belt 18 of approximately 3600 rpm is preferred for removing the thin film of material.

Figure 2:
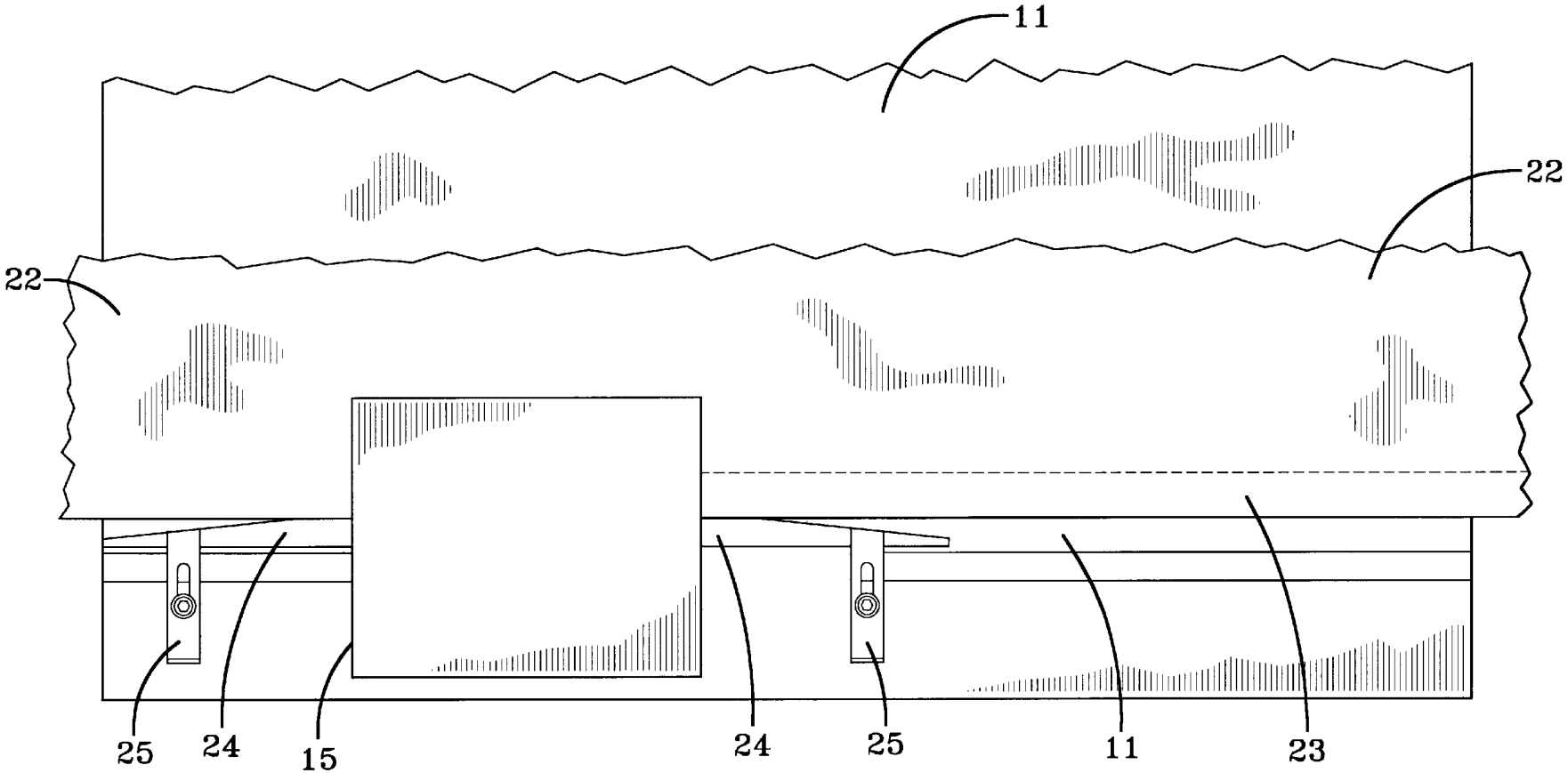
FIG. 2 is a fragmented, somewhat schematic top plan view of the device of FIG. 1.

FIG. 2 schematically shows the manner in which a sheet or panel of fabric 22 is fed through enclosure 15 and control mechanism 16 (to the right in FIG. 2). Fabric 22 can be formed of any suitable material, but film-removing device 10 is particularly suited for a fabric formed with a base cloth, for example, woven nylon or polyester; a polymeric coating on both sides of the base cloth, for example, polyvinylchloride; and a thin layer of film on the polymeric coating on one side of fabric, such as the material sold under the trademark TEDLAR® by DuPont. In actual practice, the overall thickness of fabric 22 is approximately 0.035 inch with the base cloth being approximately 0.020 inch thick, and the total amount of the polymeric coating material accounting for about 0.014 inch of the thickness. As discussed above, a portion of this film must be removed so that a sheet of fabric may be welded to another sheet. Thus, the film of material to be removed is approximately 0.001 inch thick. It is thus the goal of film-removing device 10 to completely remove this 0.001 inch thick film, at an area 23 of fabric 22 as shown in FIG. 2, preferably without removing any of the polymeric coating, and certainly not removing any of the base cloth which would be detrimental to the strength of the fabric. When so removed, the areas 23 of two sheets of fabric 22 may then be overlapped for thermal welding.

As shown in FIG. 2, a sheet of fabric 22 is fed into enclosure 15 and control mechanism 16 having its side edge positioned against an edge guide 24, the position of which is laterally adjustable by means of adjustment slides 25 which are mounted on table 11 and which carry edge guide 24. As will hereinafter be described in greater detail, as the fabric sheet 22 is processed by device 10, it will pass over an aperture 26 (FIGS. 3 and 9) formed in table 11 where it will communicate with grinder belt 18 on wheel 19 so that the film of material is removed, as at area 23, on the underside of fabric 22.

The details of control mechanism 16 which, as previously described, is contained within and supported by enclosure framework 15, will now be described with primary reference to FIG. 3. As fabric 22 is initially guided into device 10, a pair of driven pinch rollers 27 engage fabric 22 through an opening 28 in table 11. Rollers 27 thus longitudinally pull fabric 22 through device 10 in the direction of the flow arrow in FIG. 3. Dependent on the precise nature of the fabric being processed, it has been found that moving the fabric at a rate of four to seven feet per minute, with the grinder belt 18 moving at 3600 rpm, as previously described, will accurately remove the thin film of material.

Figure 6:
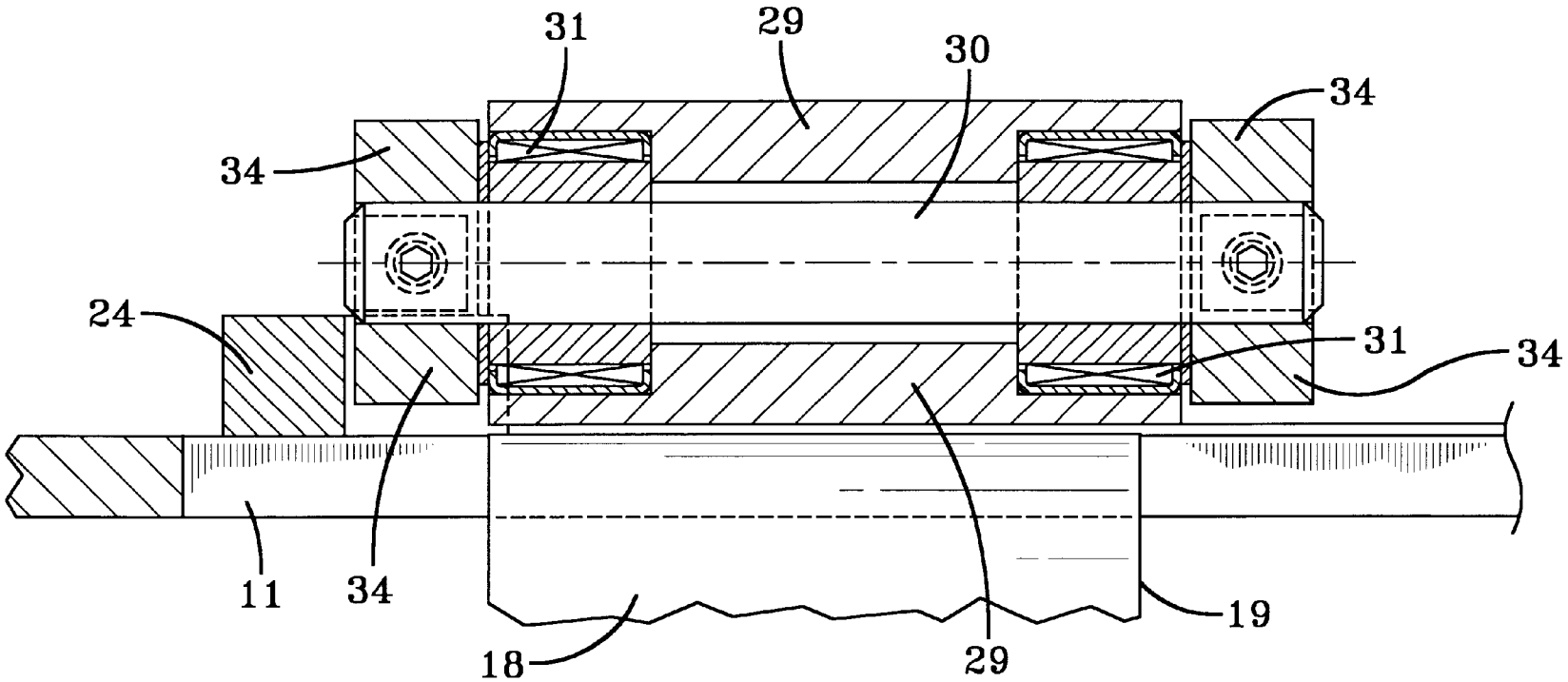
FIG. 6 is a partial sectional view taken substantially along line 6—6 of FIG. 3.
Figure 7:
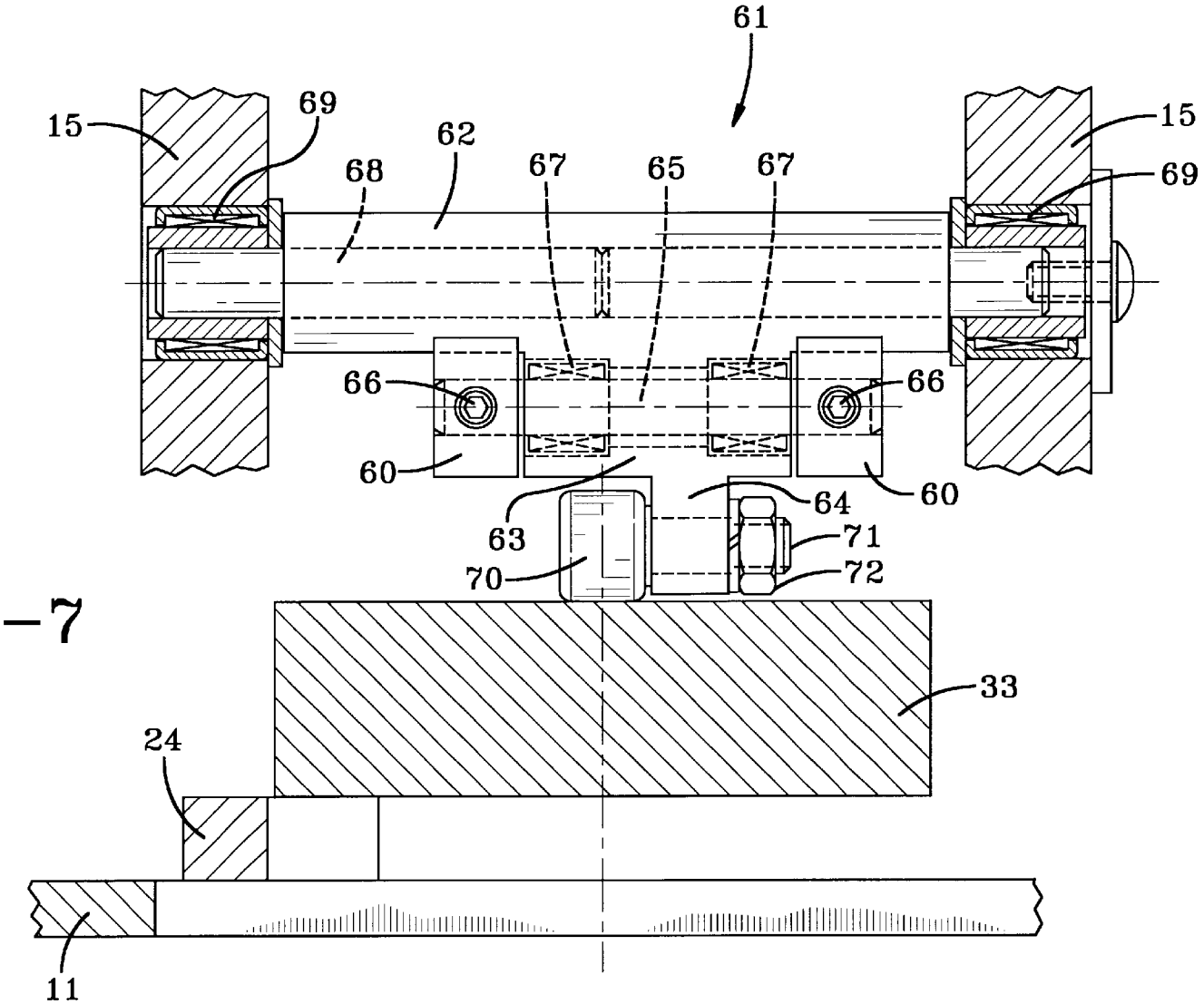
FIG. 7 is a partial sectional view taken substantially along line 7—7 of FIG. 3.

A nip member, which could be in the form of a stationary bar, but which is preferably in the form of a roller 29, is rotatably carried on a shaft 30, as by bearings 31 (FIG. 6), and is positioned over table aperture 26 and opposed to grinder wheel 19. As will hereinafter become evident, nip roller 29 bears against fabric 22 with selected, sufficient, and controlled force such that the precise amount of film is removed from fabric 22 by abrasive material 18. Shaft 30 is carried by an arm generally indicated by the numeral 32 which, as shown in FIGS. 6 and 7, is generally H-shaped having a central body portion 33 with opposed branches 34 extending from one end thereof and with opposed branches 35 extending from the other end thereof. Branches 34 carry shaft 30, and arm 32 is pivotally moveable about a pivot pin 36 extending through branches 35.

Figure 8:
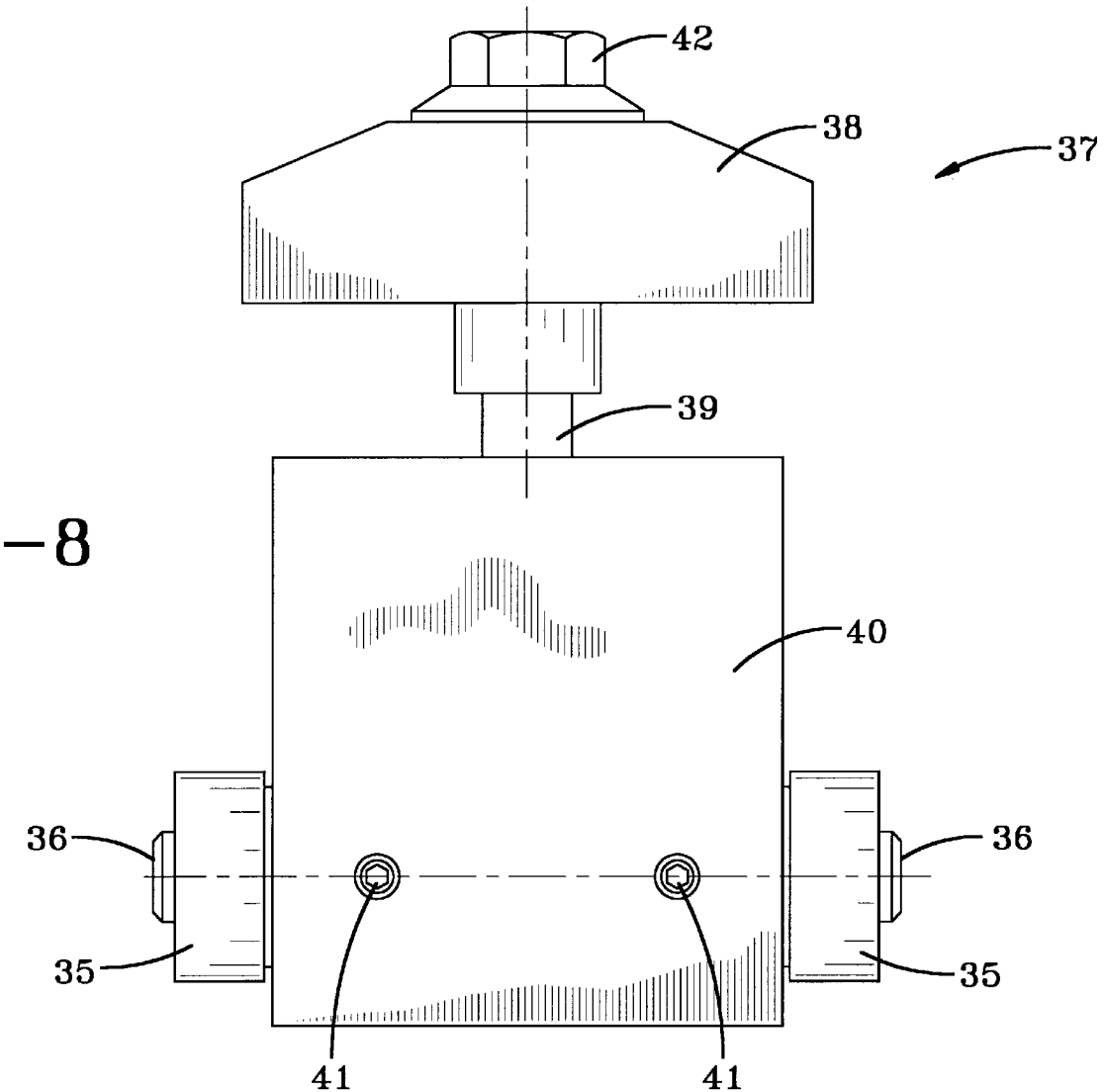
FIG. 8 is a partial sectional view taken substantially along line 8—8 of FIG. 3.

Pin 36 is vertically moveable to ultimately adjust the position of nip roller 29 by an adjusting mechanism generally indicated by the numeral 37 and shown somewhat schematically in FIG. 8. Adjusting mechanism 37 is a conventional item which includes a head 38 having a micrometer screw 39 extending downwardly therefrom and through and into enclosure 15. Screw 39 is operatively connected to an adjustment slide block 40 such that when screw 39 is rotated, block 40 will move up or down in a manner well known in the art. Block 40 is connected, as by set screws 41 or like devices, to pivot pin 36. Screw 39 is provided with a hex head 42 which allows the user to readily rotate screw 39 to vertically move block 40 and thus, pivot pin 36. As should be evident, such moves arm 32 to control the initial position of nip roller 29 relative to grinder wheel 19 dependent on the anticipated thickness of the fabric 22 being processed. If desired, adjusting mechanism 37 may be provided with micrometer markings, for example, at the area of head 38 and hex head 42 to guide the user in making the proper initial settings.

This initial position of nip roller 29 can be corrected by a thickness sensing and adjusting system, generally indicated by the numeral 43, now to be described in detail. Such correction would, for example, be necessary to account for variances in thickness of the woven fabric or polymeric coating, resulting in the device 10 being able to consistently only remove the thin film of the TEDLAR® or like material.

Figure 4:
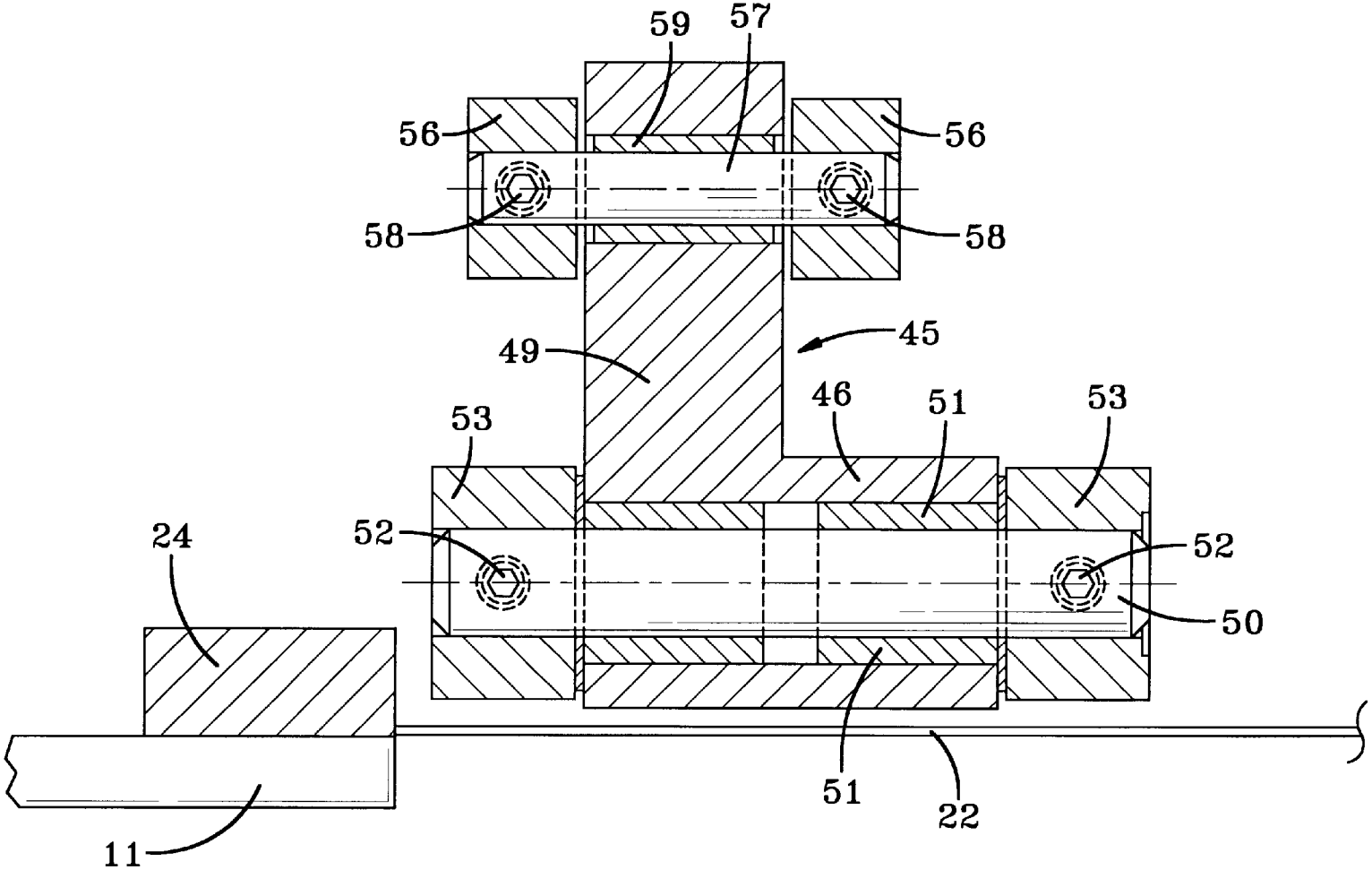
FIG. 4 is a partial sectional view taken substantially along line 4—4 of FIG. 3.
Figure 5:
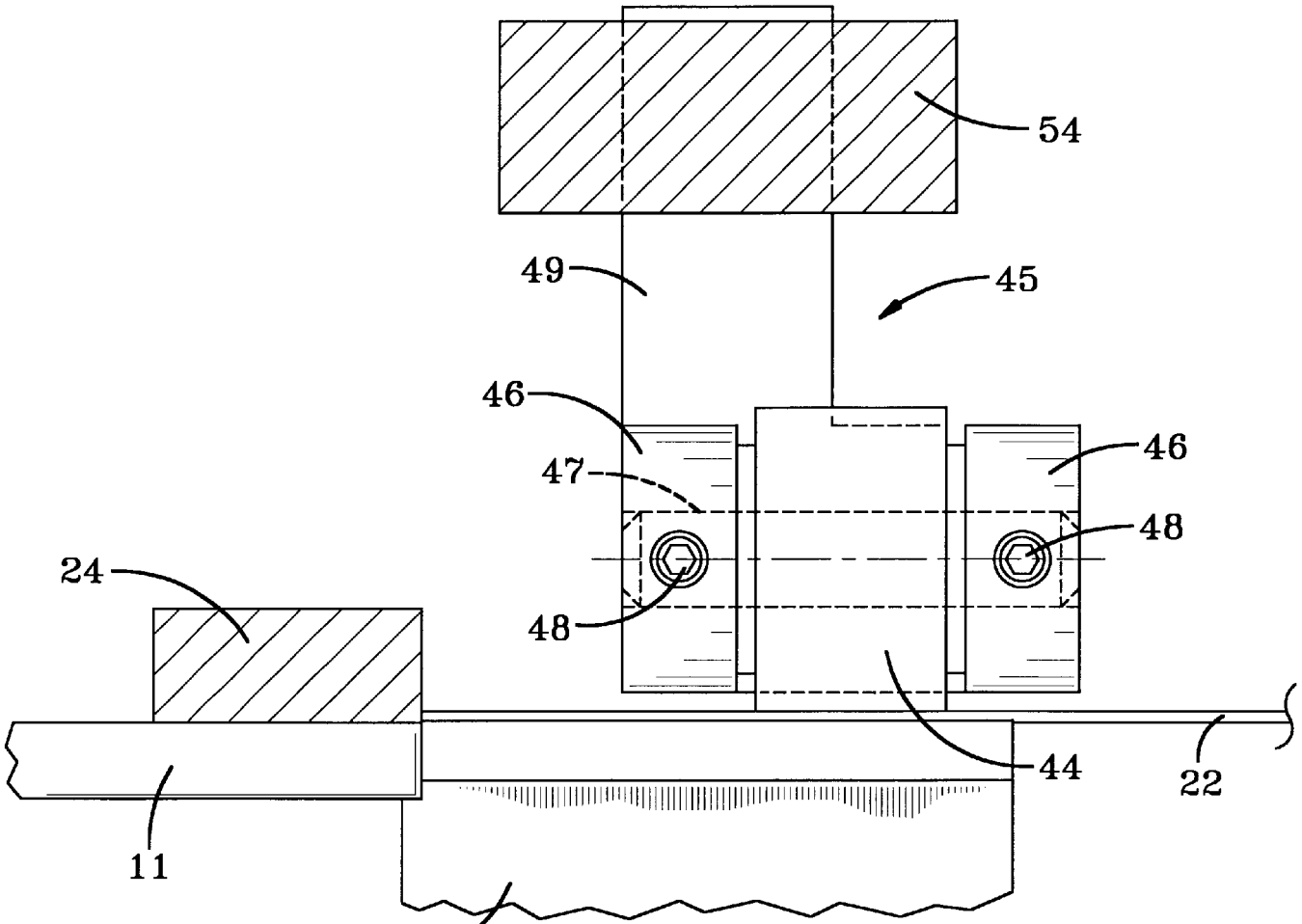
FIG. 5 is a partial sectional view taken substantially along line 5—5 of FIG. 3.

System 43 includes a sensing wheel 44 which rides on fabric 22 upstream of nip roller 29. Wheel 44 is carried by a sensing arm, generally indicated by the numeral 45, which includes a lower forked end in the form of spaced arms 46. A pin 47, upon which wheel 44 may rotate, is carried between arms 46 and is attached thereto as by set screws 48 or the like. Sensing arm 45 also includes an upstanding arm 49 which is connected to arms 46 and is shown as being offset from arms 46 (FIG. 5). The lower end of arm 49 is rotatable about a stationary pin 50 with suitable bearings 51 being provided. Pin 50 is connected, as by set screws 52 or the like, between blocks 53 (FIG. 4) positioned within enclosure framework 15. Thus, sensing arm 45 is rotatable on pin 50.

Adjusting system 43 also includes a link arm, generally indicated by the numeral 54, which includes a body portion 55 having one forked end in the form of spaced arms 56. Arms 56 carry a pin 57 therebetween, pin 57 being attached thereto as by set screws 58 or the like. Pin 57 is received through the upper end of arm 49 of sensing arm 45 for rotation thereon on bearings 59. The other end of body portion 55 of link arm 54 is also forked in the form of spaced arms 60. Arms 60 carry a regulator arm generally indicated by the numeral 61 and best shown in FIG. 7. Regulator arm 61 is generally T-shaped in configuration having an upper cross portion 62 with a hub 63 extending generally medially therefrom. A tab 64 is formed at the lower end of hub 63, that is, the opposite side thereof from cross portion 62. A pin 65 is carried between arms 60 of link arm 54 and is affixed thereto by set screws 66 or the like. Pin 65 is received through hub 63 and in conjunction with bearings 67, link arm 54 is thus rotatable on pin 65 relative to regulator arm 61. A stationary pin 68 is carried by enclosure framework 15 and is received through cross portion 62 of regulator arm 61. By means of bearings 69 formed in framework 15, regulator arm 61 is pivotable on pin 68. A follower roller 70 having a stem 71 is attached to tab 64, as by bolt 72. Roller 70 is positioned so as to ride on body portion 33 of arm 32.

Adjusting system 43 also includes a plurality of spring mechanisms now to be described. One spring 73 is positioned between enclosure framework 15 and the upper end of arm 49 of sensing arm 45 which is thereby urging arm 45 to rotate clockwise on pin 50, as viewed in FIGS. 3 and 9, to maintain wheel 33 in operative contact with fabric 22. A spring 74 associated with regulator arm 61 is positioned to maintain pressure on arm 61 to urge pins 57 and 65 to the left, as viewed in FIGS. 3 and 9, which would eliminate any errors which may be introduced because of manufacturing tolerances in the size of the apertures which receive pins 57 and 65. Still another spring 75 is positioned to urge arm 32 to move in a clockwise direction as viewed in FIGS. 3 and 9. Such not only maintains follower roller 70 on body portion 33 of arm 32, but also it prevents nip roller 29 from dropping down onto grinder wheel 19 after the fabric 22 completely passes through the system which could damage nip roller 29.

Figure 3:
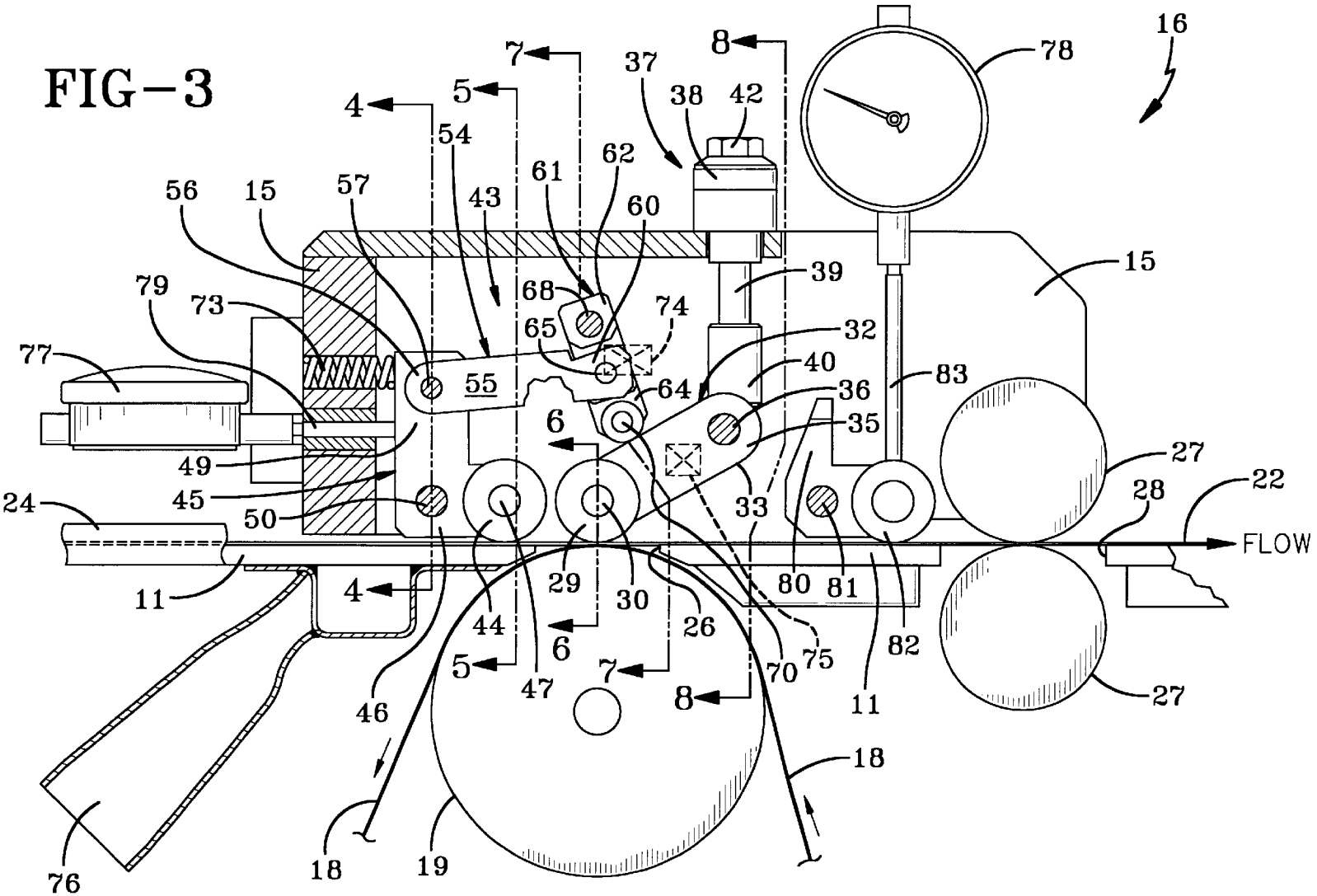
FIG. 3 is a somewhat schematic, partially sectioned side elevational view of the components of the operating mechanism of the device of FIG. 1.
Figure 9:
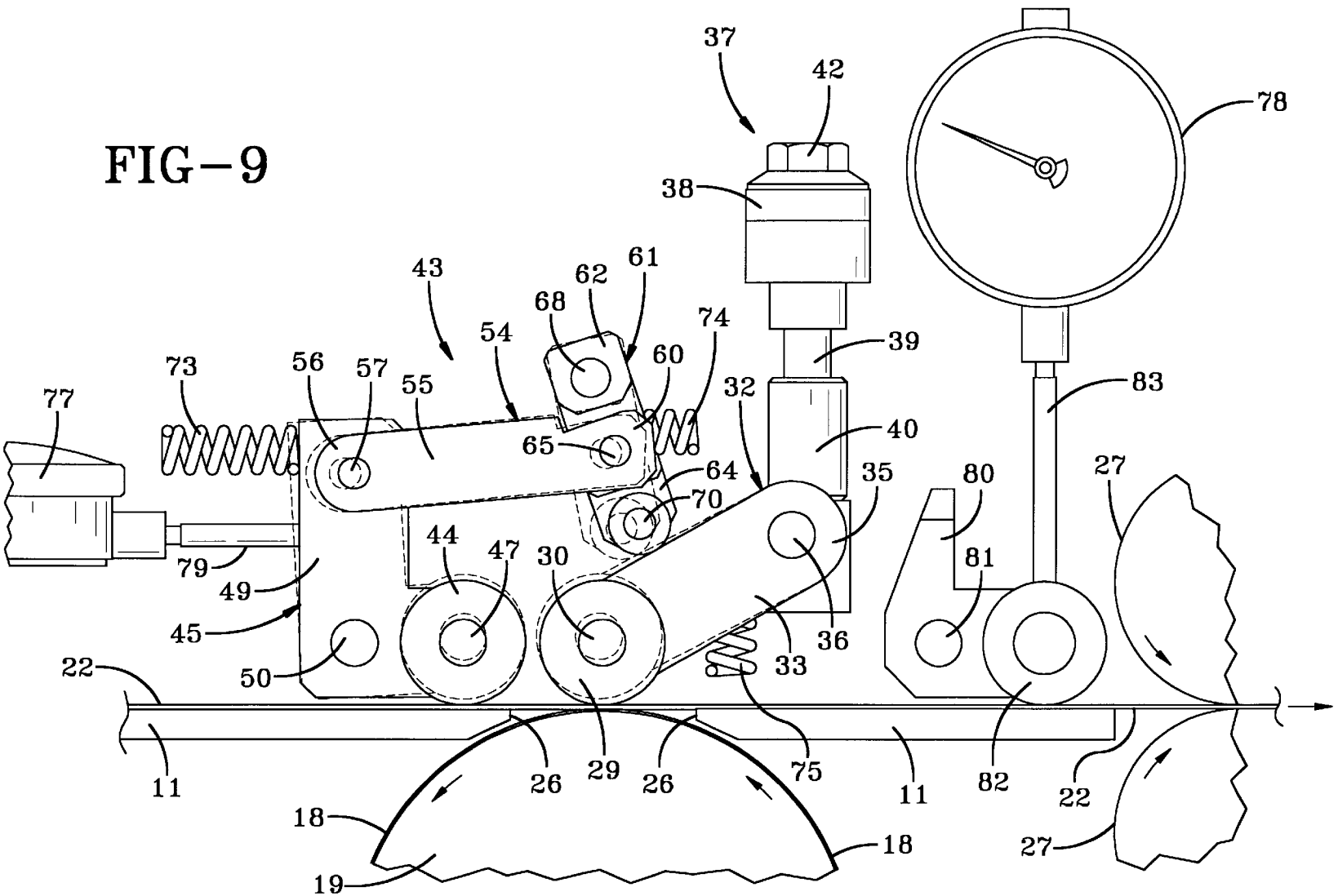
FIG. 9 is a schematic representation of the components shown in FIG. 3 depicting the manner in which the operating mechanism adjusts for differing thicknesses of the fabric.

The operation of adjusting system 43 can best be described generally in conjunction with FIG. 3 and more specifically in FIG. 9 which is a schematic version of that which is shown in FIG. 3. With the initial adjustment having been established by adjustment mechanism 37, pinch rollers 27 pull fabric 22 through device 10 along edge guide 24. Nip roller 29 thus urges fabric 22 against grinder wheel 19 so that the precise, desired amount of film is removed at area 23 on the underside of fabric 22. Grinder wheel 19 is shown as rotating in a counterclockwise direction, against the flow of fabric 22. The film removed from fabric 22 can be exhausted away from the area adjacent to grinder wheel 19 and nip roller 29 through one or more vacuum channels 76 (FIG. 3) communicating at one end with a vacuum source and at the other end with the generally area upstream of nip rollers 29 and grinder wheel 19.

As the process continues, wheel 44 is riding on fabric 22, and if fabric 22 is of perfect thickness consistency, no adjustment is necessary. However, if fabric 22 were to become thicker, for example, it is necessary to raise nip wheel 29 so that only the thin film is removed. Conversely, if fabric 22 were to become thinner, nip wheel 29 would have to be lowered to assure that all of the thin film was removed.

FIG. 9 shows, in dotted lines, the manner in which adjusting system 43 would move to accommodate a fabric 22 which is getting thicker than originally anticipated as it passes through device 10. As such, wheel 44 would move upwardly pivoting sensing arm 45 counterclockwise on pin 50 against the bias of spring 73. Such pulls link arm 54 to the left which causes regulator arm 61 to rotate counterclockwise which allows follower roller 70 to move down body portion 33 of arm 32. As a result, under the influence of spring 75, nip roller 29 is raised to accommodate the thicker fabric. Of course, if the fabric were thinner than anticipated, the movements of these components would be in the reverse.

During the operation, the thickness of fabric 22 going into device 10 and that exiting device 10 may be monitored by a conventional input thickness gauge 77 and a conventional output thickness gauge 78. Input gauge 77, via a shaft 79 which is in contact with arm 49 of sensing arm 45, senses the position of sensing arm 45 and is calibrated to associate that position with fabric thickness. With respect to output gauge 78, a bracket 80 is pivotable about a shaft 81 and carries a wheel 82 at one end thereof. Wheel 82 will thus move up or down as the output thickness of fabric 22 might become undesirably thicker or thinner, respectively. Output gauge 78, via a shaft 83 which communicates with the position of wheel 82, thus displays the output thickness of fabric 22.

In view of the foregoing, it should thus be evident that a film removing device made in accordance with the present invention can be accurately set to remove a thin film from a fabric and will automatically adjust itself in the event of a variation in the overall thickness of the fabric so that the film is completely removed without removing any significant extent of the fabric itself. As a result, the objects of the present invention are accomplished resulting in a substantial improvement in the art.

What is claimed is:

1. Apparatus for removing a thin film of material from a portion of a sheet of fabric comprising a grinding mechanism, a nip member opposed to and spaced from said grinding mechanism, the fabric being adapted to be positioned and moved in the space between said grinding mechanism and said nip member, a mechanism acting upon said nip member to establish the size of the space between said grinding mechanism and said nip member dependent on the anticipated thickness of the fabric, and a thickness-sensing system acting upon said nip member to adjust the size of the space between said grinding mechanism and said nip member as the fabric is moving between the space between said grinding mechanism and said nip member dependent on the actual thickness of the fabric so that the thin film is always removed from the fabric.

2. Apparatus for removing a thin film of material from a portion of a sheet of fabric comprising a grinding mechanism, a nip member opposed to and spaced from said grinding mechanism, the fabric being adapted to be positioned in the space between said grinding mechanism and said nip member, an arm carrying said nip member, a mechanism pivoting said arm to establish the size of the space between said grinding mechanism and said nip member, and a thickness-sensing system operatively connected to said nip member to adjust the size of the space between said grinding mechanism and said nip member dependent on the actual thickness of the fabric so that the thin film is always removed from the fabric.

3. Apparatus for removing a thin film of material from a portion of a sheet of fabric comprising a grinding mechanism, a nip member opposed to and spaced from said grinding mechanism, the fabric being adapted to be positioned in the space between said grinding mechanism and said nip member, a mechanism operatively connected to said nip member to establish the size of the space between said grinding mechanism and said nip member dependent on the anticipated thickness of the fabric, and a thickness-sensing system operatively connected to said nip member to adjust the size of the space between said grinding mechanism and said nip member dependent on the actual thickness of the fabric so that the thin film is always removed from the fabric, said thickness-sensing system including a pivotable sensing arm and a sensing wheel carried by said sensing arm, said sensing wheel riding on the fabric, said sensing arm pivoting in response to the thickness of the fabric.

4. Apparatus according to claim 3 wherein said thickness-sensing system includes a spring member biasing said sensing arm to maintain said sensing wheel on the fabric.

5. Apparatus according to claim 3 further comprising a thickness gauge operatively attached to said sensing arm so as to provide a visual readout of the thickness of the fabric.

6. Apparatus according to claim 3 wherein said thickness-sensing system includes a pivotable regulator arm operatively connected to said nip member.

7. Apparatus according to claim 6 wherein said thickness-sensing system includes a link arm pin connected between said sensing arm and said regulator arm.

8. Apparatus according to claim 7 wherein said thickness-sensing system includes a spring member biasing said regulator arm toward said sensing arm.

9. Apparatus according to claim 7 further comprising a pivotable arm carrying said nip member, said thickness-sensing system including a follower roller carried by said regulator arm and riding on said pivotable arm.

10. Apparatus according to claim 9, said mechanism pivoting said pivotable arm to establish the size of the space between said grinding mechanism and said nip member.

11. Apparatus according to claim 9 wherein said thickness-sensing system includes a spring member maintaining said follower roller on said pivotable arm.

12. Apparatus for removing a thin film of material from a portion of a sheet of fabric comprising a table having an aperture therein, the fabric being receivable on said table, a grinding mechanism, a nip member being opposed to and spaced from said grinding mechanism at the location of said aperture, a mechanism operatively connected to said nip member to establish the size of the space between said grinding mechanism and said nip member dependent on the anticipated thickness of the fabric, and a thickness-sensing system operatively connected to said nip member to adjust the size of the space between said grinding mechanism and said nip member dependent on the actual thickness of the fabric so that the thin film is always removed from the fabric.

13. Apparatus according to claim 12 further providing an edge guide attached to said table, the edge of the fabric being positionable against said edge guide.

14. Apparatus according to claim 13 further comprising driven pinch rolls adapted to engage the fabric and pull the fabric along said table.

15. Apparatus for removing a thin film of material from a portion of a sheet of fabric comprising a grinding mechanism, a nip member opposed to and spaced from said grinding mechanism, the fabric being adapted to be positioned in the space between said grinding mechanism and said nip member, a mechanism operatively connected to said nip member to establish the size of the space between said grinding mechanism and said nip member dependent on the anticipated thickness of the fabric, a thickness-sensing system operatively connected to said nip member to adjust the size of the space between said grinding mechanism and said nip member dependent on the actual thickness of the fabric so that the thin film is always removed from the fabric, a pivotally carried wheel capable of riding on the fabric after the thin film has been removed, and a thickness gauge operatively attached to said wheel so as to provide a visual readout of the thickness of the fabric.

16. Apparatus for removing a thin film of material from a portion of a sheet of fabric comprising a grinding mechanism, a nip member opposed to and spaced from said grinding mechanism so that the fabric may be positioned and moved in the space between said nip member and said grinding mechanism, and a thickness-sensing system acting upon said nip member to adjust the size of the space between said nip member and said grinding mechanism as the fabric is moving between the space between said nip member and said grinding mechanism dependent on the thickness of the fabric so that the thin film is removed from the fabric irrespective of variances in thickness of the fabric.

17. Apparatus according to claim 16 further comprising an initial space-adjusting mechanism operatively connected to said nip member to establish the size of the space between said nip member and said grinding mechanism dependent on the anticipated thickness of the fabric.

18. Apparatus according to claim 17 further comprising an arm carrying said nip member, said initial space-adjusting mechanism pivoting said arm to establish the size of the space between said nip member and said grinding mechanism, and said thickness-sensing mechanism allowing said arm to pivot upon sensed deviations of the thickness of the fabric.

19. A method of removing a thin film of material from a portion of a sheet of fabric by utilizing a grinding mechanism comprising the steps of positioning a nip member adjacent to and spaced from the grinding mechanism, passing a portion of the fabric between the nip member and the grinding mechanism so that the grinding mechanism removes the film from the fabric, while the fabric is passing between the nip member and the grinding mechanism continually sensing the thickness of the fabric before the fabric passes between the nip member and the grinding mechanism, and adjusting the space between the nip member and the grinding mechanism dependent on the sensed thickness while the fabric is passing between the nip member and the grinding mechanism.

20. A method according to claim 19 further comprising the step of establishing the initial space between the grinding mechanism and nip member dependent on the anticipated thickness of the fabric.

* * * * *